US006621009B1

(12) United States Patent
Okuno et al.

(10) Patent No.: US 6,621,009 B1
(45) Date of Patent: Sep. 16, 2003

(54) ELECTRICAL CONDUCTOR SUPPORT INSULATOR

(75) Inventors: Michiharu Okuno, Tokyo (JP); Aiichiro Hashizume, Tokyo (JP); Junichiro Nishitani, Tokyo (JP); Masahiro Arioka, Tokyo (JP); Masaaki Takeshita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/709,369

(22) Filed: Nov. 13, 2000

(51) Int. Cl.[7] ..... H01B 17/00
(52) U.S. Cl. ..... 174/154; 174/40 R; 174/157
(58) Field of Search ..... 174/154, 40 R, 174/157, 158 R, 160, 163 R, 167, 168; 361/605

(56) References Cited

U.S. PATENT DOCUMENTS

| | | | | | |
|---|---|---|---|---|---|
| 971,785 | A | * | 10/1910 | Pierce | 174/156 |
| 1,920,978 | A | * | 8/1933 | Fort | 174/157 |
| 2,174,723 | A | * | 10/1939 | Hocher | 174/154 |
| 2,219,727 | A | * | 10/1940 | Stewart | 174/164 |
| 2,269,409 | A | * | 1/1942 | McChesney, Jr. | 174/154 |
| 3,300,576 | A | * | 1/1967 | Hendrix et al. | 174/146 |
| 3,739,075 | A | * | 6/1973 | Jean et al. | 174/40 R |
| 4,941,834 | A | * | 7/1990 | DeLeo | 174/138 F |
| 6,222,133 | B1 | * | 4/2001 | St. Louis | 174/138 J |
| 6,248,956 | B1 | * | 6/2001 | Cook et al. | 174/154 |

FOREIGN PATENT DOCUMENTS

| | | |
|---|---|---|
| DE | 1265262 B | 4/1968 |
| DE | 1 265 262 | 4/1968 |
| DE | 3428550 A1 | 2/1986 |
| DE | 195 39 454 C1 | 1/1997 |
| DE | 19539454 C1 | 1/1997 |
| FR | 119 4113 | 11/1959 |
| FR | 122 2403 | 6/1960 |
| FR | 127 1237 | 1/1962 |
| FR | 2308173 A | 11/1976 |
| FR | 2 308 173 | 11/1976 |
| JP | 62-131313 | 8/1987 |
| JP | 4-114721 | 10/1992 |

* cited by examiner

*Primary Examiner*—Dean A. Reichard
*Assistant Examiner*—Jinhee J Lee
(74) *Attorney, Agent, or Firm*—Sughrue Mion, PLLC

(57) ABSTRACT

An electrical conductor support insulator for passing through and supporting a main circuit conductor within a hole of the conductor support insulator. When the main circuit conductor is an electrical insulating material, all portions except for the conductor connection portion are insulated, so that no bare live portion is present and space insulation distance is made short.

12 Claims, 10 Drawing Sheets

ELECTRICAL CONDUCTOR SUPPORT INSULATOR

BACKGROUND OF THE INVENTION

This invention relates to an electrical conductor support insulator for supporting an electrical conductor.

FIG. 11 is a side view illustrating a manner in which a main circuit conductor within a switchgear is supported by a conventional conductor support insulator hereinafter referred to as the first conventional insulator). In FIG. 11, the reference numeral 11 is an electrically insulating support insulator, and a bushing 12 with a female thread therein is provide at the upper and the lower end portions of the conductor support insulator 11. The lower end portion of the conductor support insulator 11 is secured to a support frame 14 by a bolt 13 thread-engaged into the bushing 12. Also, a main circuit conductor 15 disposed within a switchgear is mounted to the conductor support insulator 11 by a bolt 16 thread-engaged with the bushing 12.

In supporting the main circuit conductor 15 disposed within the switchgear, the conductor support insulator 11 is secured to the support frame 14 by the bolt 13, forming in the main circuit conductor 15 a mounting hole through which the bolt 16 is passed, and the main circuit conductor 15 is secured by the bolt 16 directly to the conductor support insulator 11.

FIG. 12 is a side view illustrating another manner in which a main circuit conductor within a switchgear is supported by a conventional conductor support insulator (hereinafter referred to as the second conventional insulator). In FIG. 12, the reference numeral 21 is an electrically insulating support insulator, and a bushing 22 with a female thread therein is provide at the upper and the lower end portions of the conductor support insulator 21. The lower end portion of the conductor support insulator 21 is secured to a support frame 23 by through the bushing 22. At the upper end portion of the conductor support insulator 21, an L-shaped support metal fitting 24 is secured by the bolt 25 thread-engaged into the bushing 22. Also, a main circuit conductor 26 disposed within a switchgear is mounted to the support metal fitting 24 by a bolt.

In supporting the main circuit conductor 26 disposed within the switchgear, the conductor support insulator 21 is secured to the support frame 23 and mounting the support metal fitting 24 to the conductor support insulator 21 by the bolt 25, forming in the main circuit conductor 26 a mounting hole through which the bolt 27 is passed, and the main circuit conductor 26 is secured by the bolt 27 to the support metal fitting 24.

With the conventional conductor support insulator, the main circuit conductor was supported as above described, so that, when the main circuit conductors 15 or 26 disposed within a switchgear is to be supported, a mounting hole must be formed in the main circuit conductor 15 or 26 both in the first and the second conventional insulators, Also, in the second conventional insulator the support metal fitting 24 must be used.

Further, both in the first and the second conventional insulators, the bushing 12 or 22 must be embedded within the conductor support insulator 11 or 21, thus increasing the cost and, when the main circuit conductor 15 or 26 which is an insulated conductor is to be supported, the bushings 12 or 22 are at intermediate potential which may lead to the insulation breakdown, causing a problem of failure in maintaining a necessary electrical insulation performance.

Therefore, to cope with this problem, the insulation is removed from the fixed portion to make it at the same potential as the bare live portions but this raises another problem of difficulty in decreasing the space insulation distance with respect to the main circuit conductors in other phases and the grounded metal.

Further, in the first conventional insulator, when the conductor support insulator 11 is to be mounted to the support frame 14, the bolt 13 must be inserted and thread-engaged in the insulator from the back side of the support frame 14, resulting in a difficult and inefficient operability .

SUMMARY OF THE INVENTION

The present invention has been made in view of the above circumstance and has as its object the provision of an electrical conductor support insulator in which, by providing a hole that can pass and support a plurality of kinds of conductors, no bushing is provided and no securing member such as bolt and support metal fitting is needed and in which various kinds of electrical conductors can be simply and easily supported.

Another object of the present invention is to provide an electrical conductor support insulator in which the step portion is made to have a cross-shaped cross section, whereby the amount of the insulating material to be used can be reduced and the cost can be decreased.

Still another object of the present invention is to provide an electrical conductor support insulator in which one portion of the mounting portion to be secured to an external member such as the support frame or the like is formed into a slot having a U-shape, whereby the assembly efficiency can be improved.

With the above objects in view, the electrical conductor support insulator of the present invention is provided with a hole for passing therethrough and supporting an electrical conductor.

In this electrical conductor support insulator, one or a plurality of conductors are passed through and supported in the hole. Therefore, the conductors disposed within a switchgear can be easily supported without using a special member such as the bolt or the support metal fitting as used in the conventional insulator. Also, no bushing is used, so that the space insulation distance can be reduced and the insulated conductor can be held as it is.

An edge of the hole may be formed into a curved configuration in which patterns are partially different for passing through and supporting a plurality of electrical conductors of different configurations.

With this electrical conductor support insulator, the hole configuration is selected so that its fits to various kinds of conductors. Therefore the various conductors can be supported and various conductor arrangements within the switchgear can be realized.

The configuration of a stem portion may have a cross-shaped cross section.

With this electrical conductor support insulator, the stem portion of the insulator may have a cross section of the cross-shape in order to maintain the strength. Therefore, the insulating material used can be reduced as compared to the stem of cylindrical shape.

A fixed portion for being fixed to an external body may be provided, and one portion of the fixed portion may be formed into a slit of a U-shape.

With this electrical conductor support insulator, the fixed portion to be fixed to the external body may be formed into the slit of the U-shape. Therefore, the mounting operation of the conductor support insulator to the external body can be achieved from the insulator side, resulting in an improvement in the operation efficiency.

BRIEF DESCRIPTION OF THE DRAWINGS

The present invention will become more readily apparent from the following detailed description of the preferred embodiments taken in conjunction with the accompanying drawings, in which.

DESCRIPTION OF THE PREFERRED EMBODIMENTS

Figure 1A:
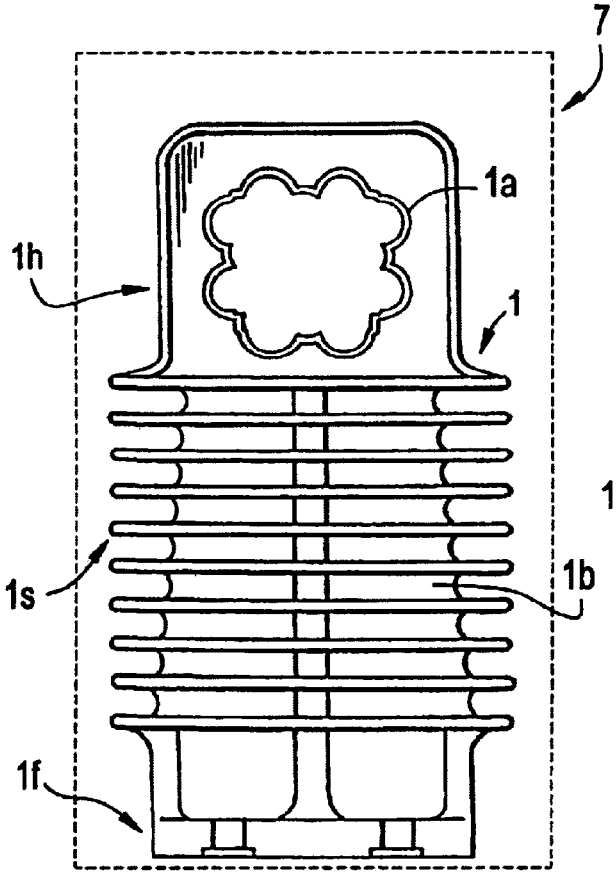
FIG. 1*a* is a front view of the electrical conductor support insulator of the present invention.
Figure 1B:
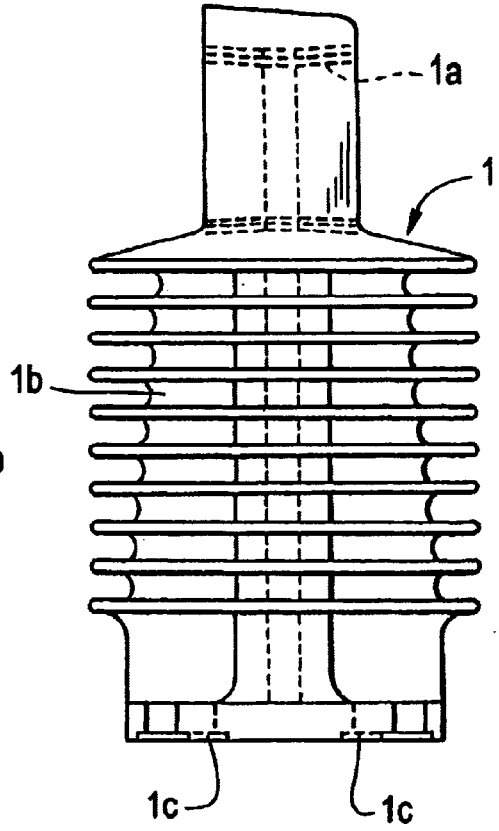
FIG. 1*b* is a side view of the electrical conductor support insulator of the present invention.
Figure 2A:
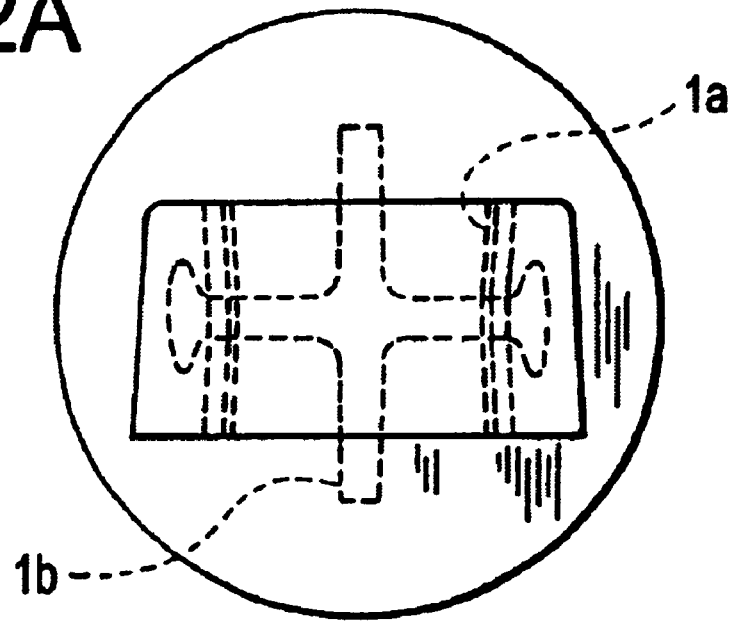
FIG. 2*a* is a top view of the electrical conductor support insulator of the present invention.
Figure 2B:
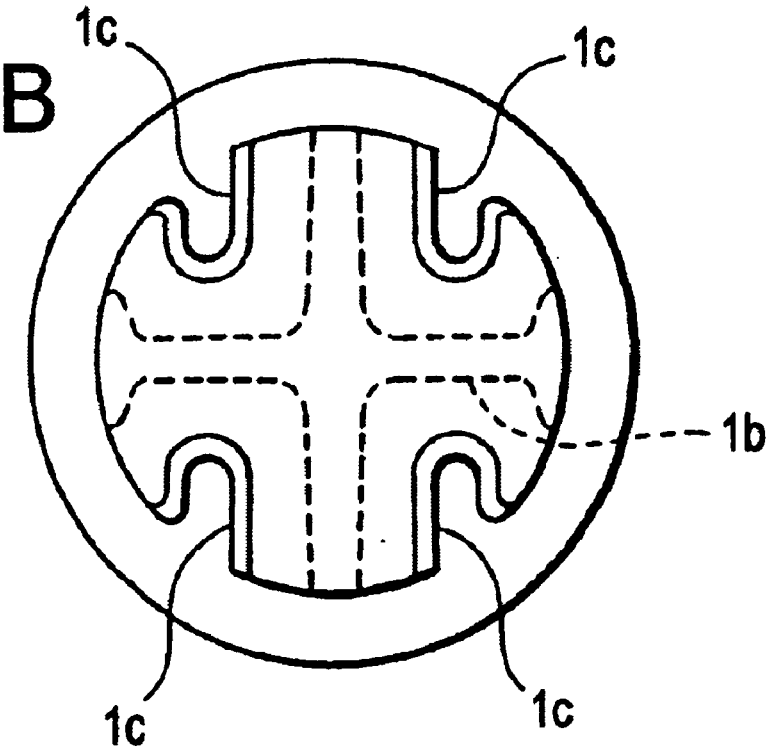
FIG. 2*b* is a bottom view of the electrical conductor support insulator of the present invention.

FIGS. 1*a* and 1*b* are front and side views of the electrical conductor support insulator of the present invention, and FIGS. 2*a* and 2*b* are top and bottom views of the electrical conductor support insulator of the present invention.

In the upper portion (head portion) 1*h* of the conductor support insulator 1, a hole 1*a* for passing through and supporting various kinds of main circuit conductors disposed within a switchgear 7 is formed. The circumferential edge of this hole 1*a* has a configuration in which arcs of various radii are connected so that the main circuit conductors of one or a plurality of various configurations may be passed therethrough and supported.

Also, in the middle portion (stem portion) Is of the conductor support insulator 1, a reinforcing member 1*b* for maintaining a mechanical strength is provided. Also, the lower portion (foot portion) 1*f* of the conductor support insulator 1, which is a mounting portion to a support frame 3 which will be described later, has formed at four positions of the mounting portion substantially U-shaped slits for providing bolt mounting portion 1*c*.

The conductor support insulator 1 of the abovedescribed structure is integrally molded with a molding material of epoxy resin groups and glass base material polyester resin groups.

Figure 3:
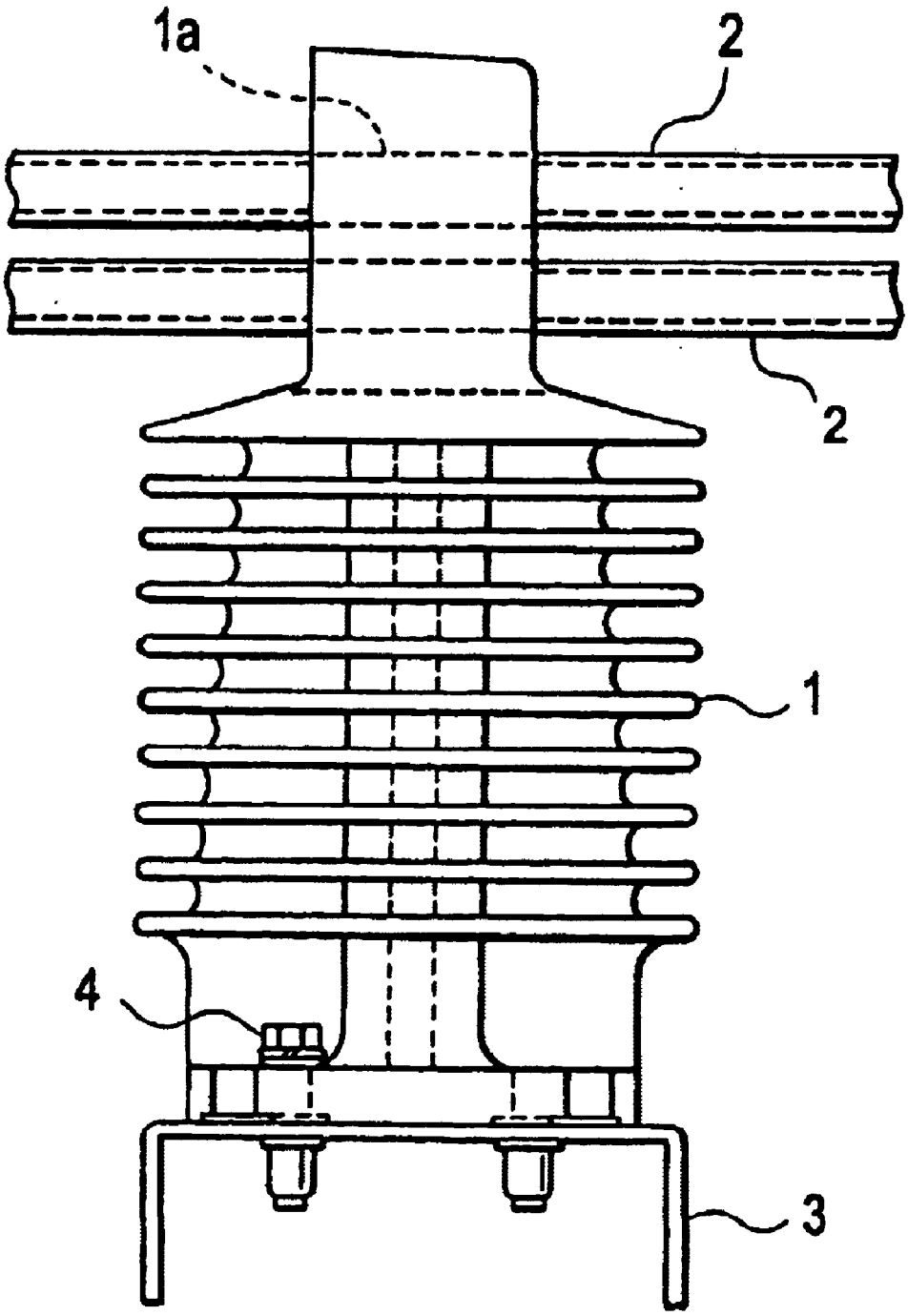
FIG. 3 is a side view showing an example of the manner in which a main circuit conductor is supported by the electrical conductor support insulator of the present invention.
Figure 4:
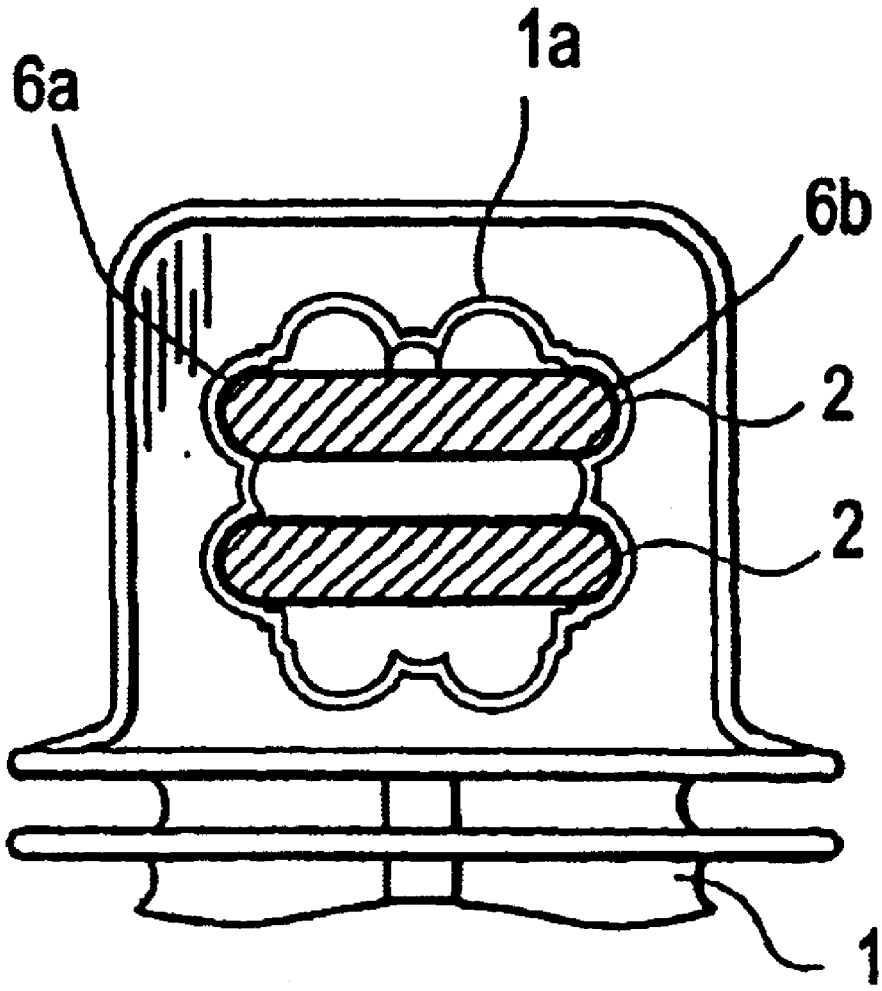
FIG. 4 is an enlarged front view showing the manner in which the support example shown in FIG. 3 is realized.

Next, the description will be made as to the manner in which the main circuit conductors within a switchgear are supported by means of the conductor support insulator 1 of the abovedescribed structure. FIGS. 3 and 4 are a side view and an enlarged front view showing an example of the manner in which a main circuit conductor is supported by the electrical conductor support insulator. In the example shown in FIGS. 3 and 4, two main circuit conductors 2, 2 are passed through and supported by the hole 1*a* of the conductor support insulator 1 in the horizontal direction. In order to simply the discussion of this example, the portions of hole 1*a* that support the top circuit conductor can be identified as first support portion 6*a* and second support portion 6*b*. However, such first and second support portions can be any two opposing portions of the hole 1*a*.

Figure 5:
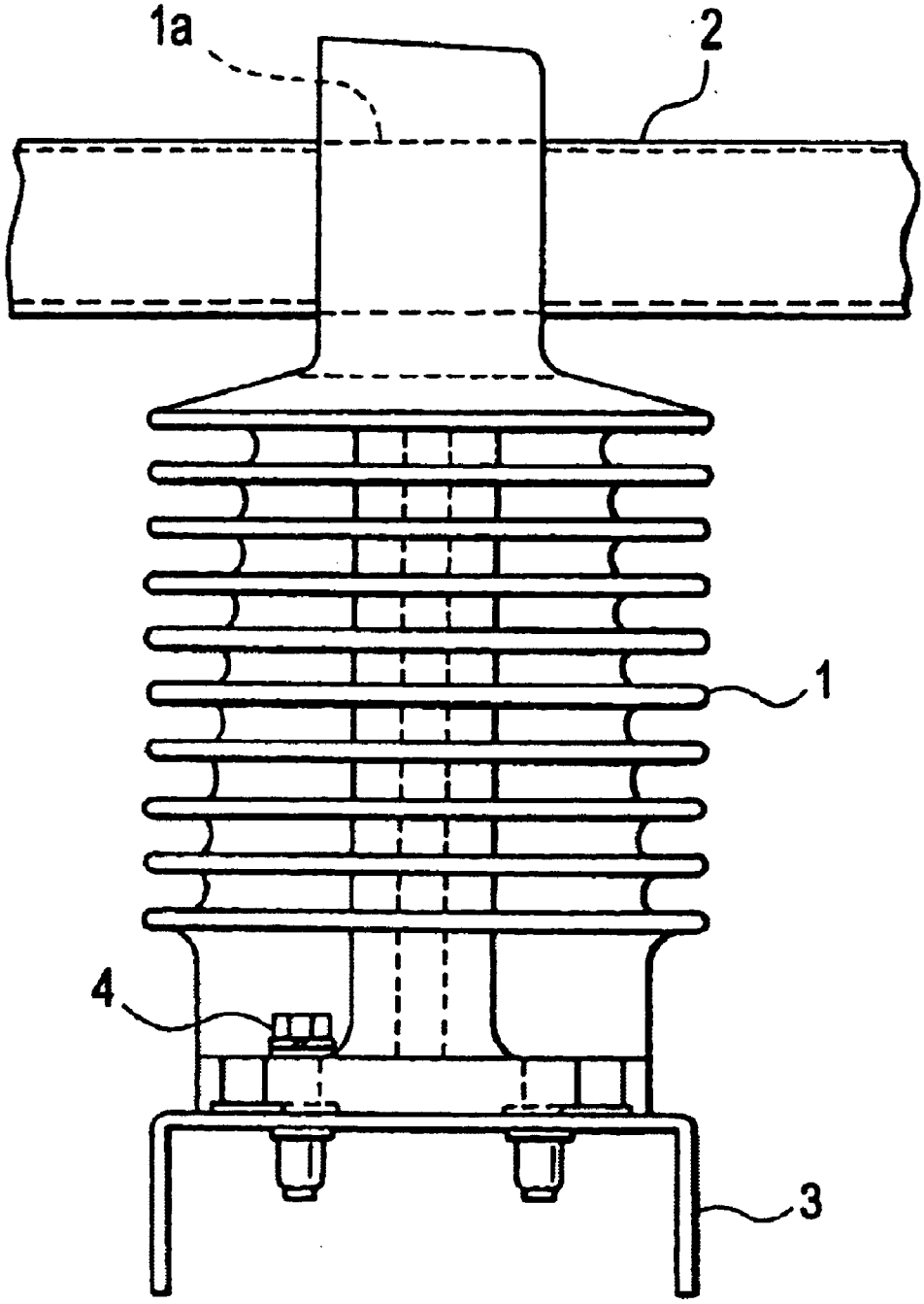
FIG. 5 is a side view showing another example of the manner in which a main circuit conductor is supported by the electrical conductor support insulator of the present invention.
Figure 6:
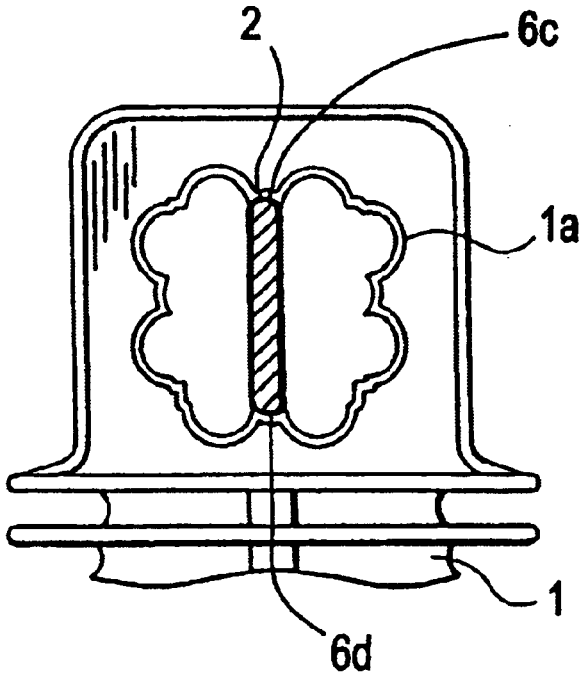
FIG. 6 is an enlarged front view showing the manner in which the support example shown in FIG. 6 is realized.

Also, FIGS. 5 and 6 are a side view and an enlarged front view showing another example of the manner in which a main circuit conductor is supported by the electrical conductor support insulator. In the example shown in FIGS. 5 and 6, a single main circuit conductor 2 is passed through and supported by the hole 1*a* of the conductor support insulator 1 in the vertical direction. In order to simply the discussion of this example, the portions of hole 1*a* that support, the circuit conductor 2 can be identified as third support portion 6*c* and fourth support portion 6*d*. However, such third and fourth support portions can be any two opposing portions of the hole 1*a*.

Figure 7:
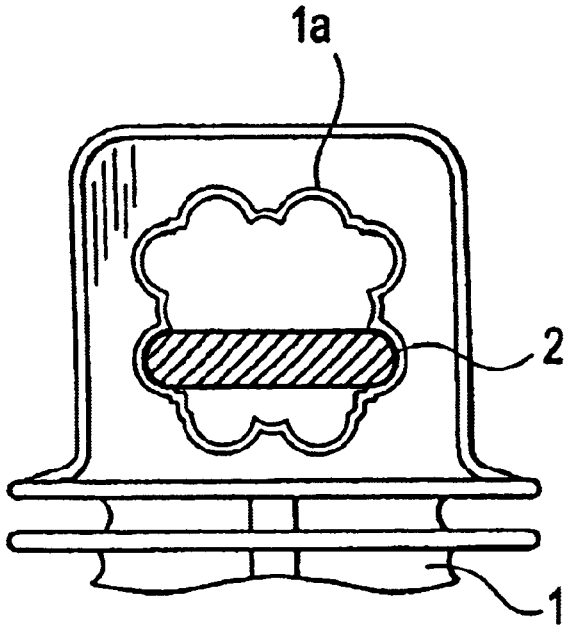
FIG. 7 is an enlarged front view showing a still another example of the manner in which a main circuit conductor is supported boy the electrical conductor support insulator of the present invention.
Figure 8:
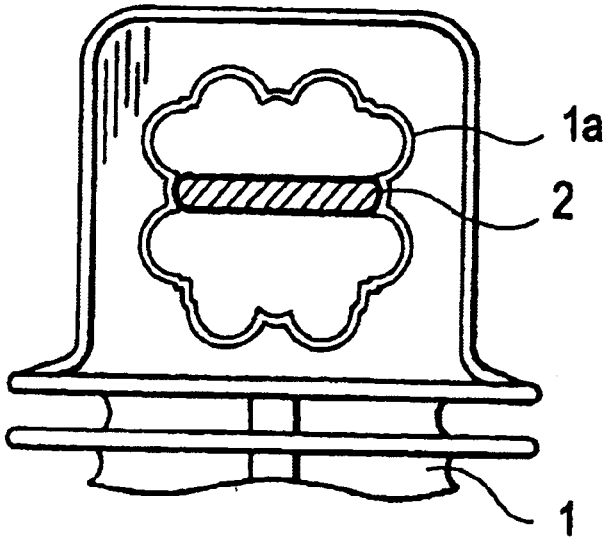
FIG. 8 is an enlarged front view showing a still another example of the manner in which a main circuit conductor is supported by the electrical conductor support insulator of the present invention.
Figure 9:
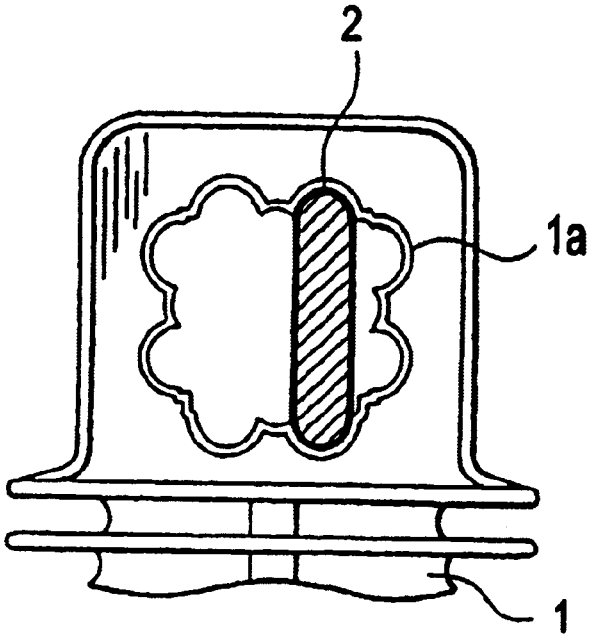
FIG. 9 is an enlarged front view showing a still another example of the manner in which a main circuit conductor is supported by the electrical conductor support insulator of the present invention.
Figure 10:
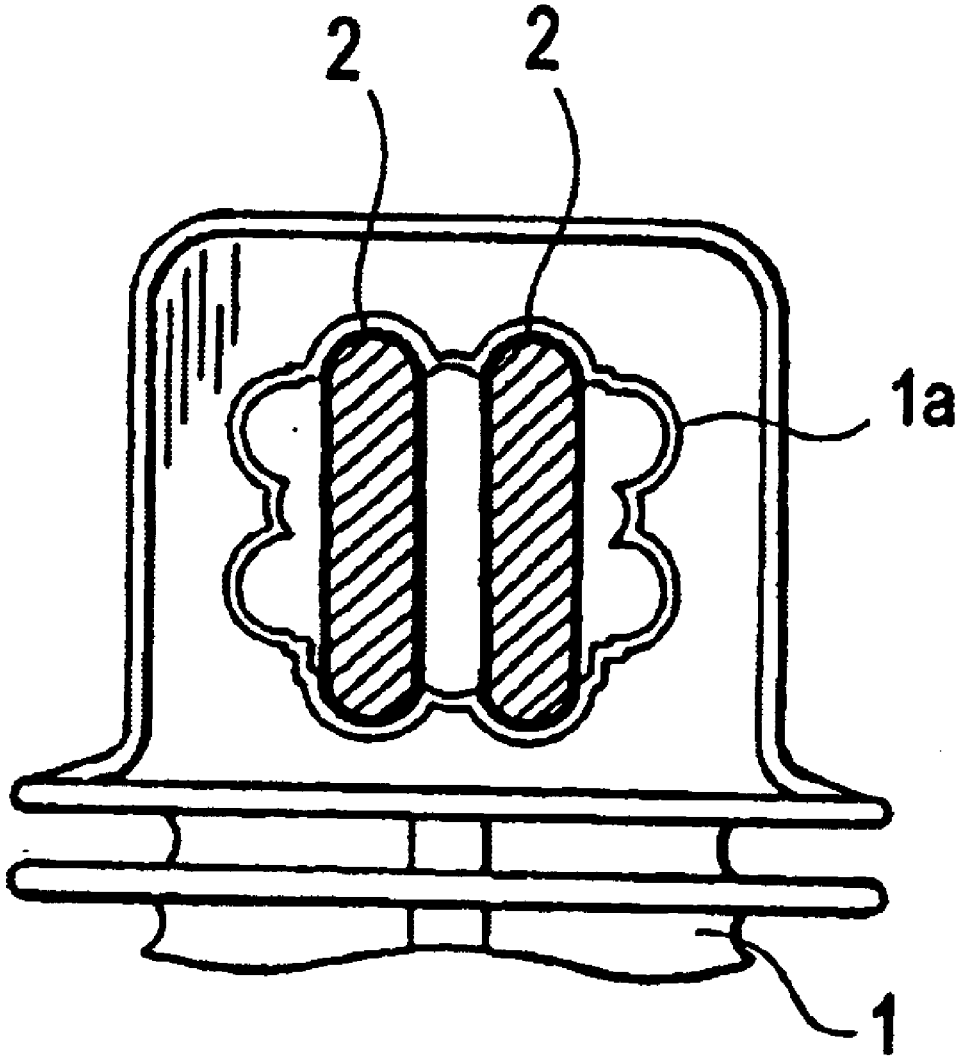
FIG. 10 is an enlarged front view showing a still another example of the manner in which a main circuit conductor is supported by the electrical conductor support insulator of the present invention.
Figure 11:
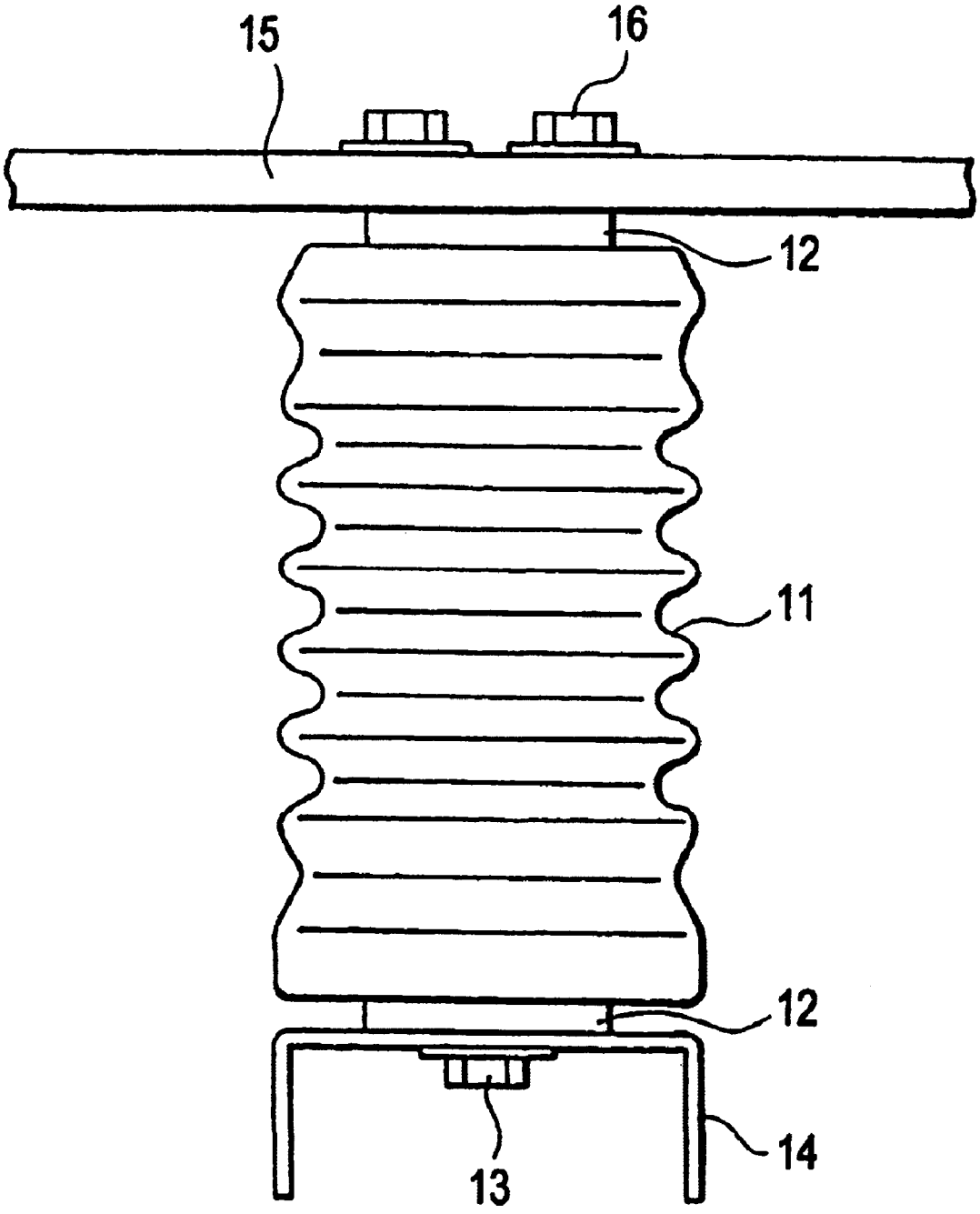
FIG. 11 PRIOR ART
FIG. 11 is a side view showing an example of the manner in which a main circuit conductor is supported by a conventional electrical conductor support insulator.
Figure 12:
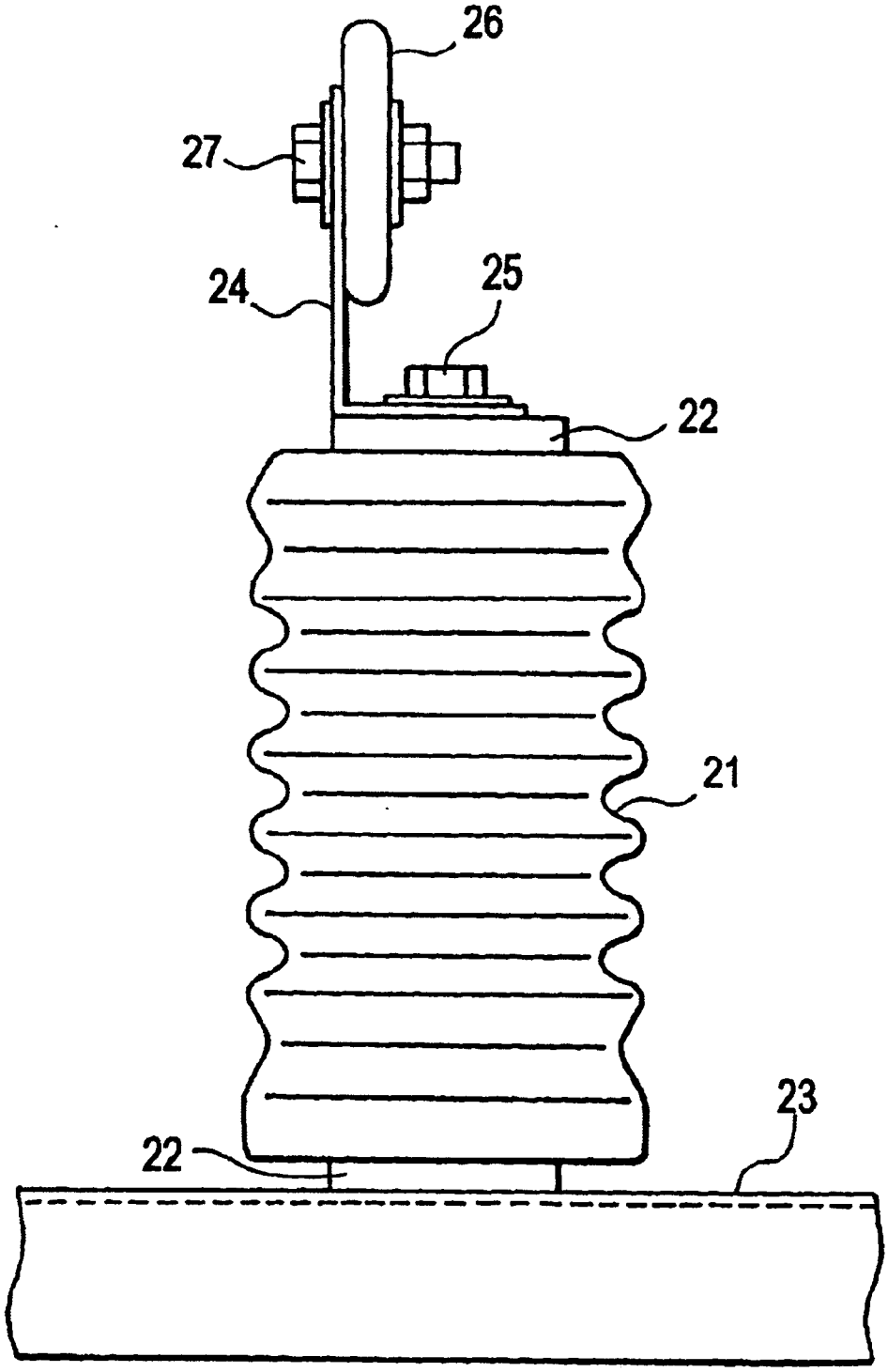
FIG. 12 PRIOR ART
FIG. 12 is a side view showing an example of the manner in which a main circuit conductor is supported by another conventional electrical conductor support insulator.

Further, FIGS. 7 to 10 are enlarged front views showing still other examples of the manner in which a main circuit conductor is supported by the electrical conductor support insulator. In the example shown in FIG. 7, a single main circuit conductor 2 that has a width equal to that of the examples shown in FIGS. 3 and 4 is passed through and supported by the hole 1*a* of the conductor support insulator 1 in the horizontal direction. In the example shown in FIG. 8, a single main circuit conductor 2 that has a width smaller than that of the example shown in FIG. 7 is passed through and supported by the hole 1*a* of the conductor support insulator 1 in the horizontal direction. In the example shown in FIG. 9, a single main circuit conductor 2 that has a width larger than that of the example shown in FIGS. 5 and 6 is passed through and supported by the hole 1*a* of the conductor support Insulator 1 in the vertical direction. In the example shown in FIG. 10, two main circuit conductors 2, 2 that has a width equal to that of the example shown in FIG. 9 are passed through and supported by the hole 1*a* of the conductor support insulator 1 in the vertical direction.

As described above, the manner in which the main circuit conductor 2 to be supported is mounted (the horizontal mounting, the vertical mounting), the size (large width, small width) and number (one, two) can be selected according to the current to be carried. It is to be noted that the above described configuration of the hole 1*a* of the conductor support insulator 1 and the mounting example of the main circuit conductor 2 are mere examples and that the present invention is not limited thereto.

Next, the description will be made as to the support procedure of the main circuit conductor 2. First, the conductor support insulator 1 is secured to the support frame 3 by a mounting bolt 4 through the bolt mounting portion 1*c* of the conductor support insulator 1 (see FIGS. 3 and 5). At this time, through the use of a weld nut, nut insert or the like on the support frame 3 side, this mounting operation can completely be achieved from the conductor support insulator 1 side, thus improving the operation efficiency. Also, the mounting position of the conductor support insulator 1 relative to the support frame 3 can be determined by moving the mounting bolts 4 within the bolt mounting portion 1*c* of the U-shaped slits.

Then, one or two main circuit conductors 2 to be supported within the switchgear is passed through and supported by the hole 1*a* of the conductor support insulator 1. At this time, the arc shape of the circumference edge of the hole 1*a* is utilized to support one or plurality of main circuit conductors 2 by the conductor support insulator 1 without using any mounting member such as bolts, support metal fittings or the like. Also, including the above-discussed support examples, various main circuit conductors 2 can be supported by the conductor support insulator 1 irrespective of their size, shape and number.

Also, since the main circuit conductor 2 can be supported without the need for the bolt mounting, when an electrically insulated main circuit conductor 2 is used, the main circuit conductor 2 can be supported with the insulation maintained, so that the space insulating distance with respect to other main circuit conductors, surrounding grounded metal members can be shortened as compared to the conventional design.

As has been described, according to the electrical conductor support insulator of the present invention, a hole for passing therethrough and supporting an electrical conductor is provided, so that the conductor can be easily supported without the need for the use of any special member such as bolts, support metal fittings or the like conventionally needed. Also, the bushing in the conductor support insulator is made unnecessary, allowing the space insulation distance to be shortened and an insulated conductor can be held as it is. Also, any special mounting member such as bolts, support metal fittings or the like is not needed, allowing the number of parts to be decreased and the operation time to be shortened, resulting in a low cost switchgear.

Also, a circumference edge of the hole may be formed into a curved configuration in which patterns are partially different for passing through and supporting a plurality of electrical conductors of different configurations, so that various kinds of conductors of different shapes can be supported, permitting various conductor arrangements within the switchgear.

Also, the configuration of a stem portion has a cross-shaped cross section, so that the amount of insulator material can be reduced, thereby the reduction of cost can be realized.

Further, a mounting portion for being fixed to an external body such as the support frame is provided, and one portion of said fixed portion is formed into a slit of a U-shape, so that the mounting operation of the conductor support insulator can be carried out from the side of the conductor support insulator and does not have to be carried out from the back side of the support frame as clone in the conventional technique, enabling the improvement in the operation efficiency.

What is claimed is:

1. An electrical conductor support insulator, comprising:

a head portion for supporting an electrical conductor; wherein:

said head portion includes a hole through which said electrical conductor is passed; and a perimeter of said hole is formed by arcs of varying radii for passing and supporting electrical conductors of different configurations; wherein said perimeter formed by said arcs is made of concave segments adjacent to each other.

2. An electrical conductor support insulator as claimed in claim 1, wherein a fixed portion for being fixed to an external body is provided, and one portion of said fixed portion is formed into a slit of a U-shape.

3. An electrical conductor support insulator as claimed in claim 1, wherein said hole has a configuration for supporting a plate-like bar conductor.

4. An electrical conductor support insulator as claimed in claim 1, wherein a fixed portion for being fixed to an external body is provided, and one portion of said fixed portion is formed into a slit of a U-shape.

5. An electrical conductor support insulator as claimed in claim 1, wherein said hole has a configuration for supporting a plate-like bar conductor.

6. An electrical conductor support insulator, comprising:

a head portion formed to support a plurality of electrical conductors and having a hole through which said electrical conductors are passed, said hole having a perimeter provided with a first support portion and a second support portion at different positions for supporting a first electrical conductor, and said first support portion and said second support portion having a thickness in a direction of extension of said first electrical conductor; wherein said thickness contacts said first electrical conductor along a substantive length of said first electrical conductor.

7. An electrical conductor support insulator as claimed in claim 6, wherein said hole has a configuration for supporting a plate-like bar conductor.

8. An electrical conductor support insulator as claimed in claim 6, wherein said first and second support portions for supporting a first conductor, as well as a third and a fourth support portion for supporting a second electrical conductor having a configuration different from said first conductor, are disposed at different positions of the perimeter of said hole.

9. An electrical conductor support insulator as claimed in claim 8, wherein said first and said third support portions or said second and said fourth support portions have curves of different patterns.

10. An electrical conductor support insulator, comprising:

a head portion for supporting an electrical conductor; and a stem portion extending from said head portion and having a cross-shared cross section perpendicular to the direction of extension;

wherein said head portion includes a hole through which said electrical conductor is passed.

11. An electrical conductor support insulator, comprising:

a head portion for supporting an electrical conductor; and a planar foot portion mounting said electrical conductor support insulator to an external body; wherein:

said foot portion further comprises a bolt mounting portion formed by a U-shaped slit opening outward;

said foot portion surrounding said bolt mounting portion is thin and formed to be positioned between a head of a fastener and said external body; and said head portion includes a hole through which said electrical conductor is passed.

12. An electrical conductor support insulator, comprising:

a head portion for supporting an electrical conductor, wherein said head portion includes a hole through which said electrical conductor is passed;

said head portion is substantially planar; and said perimeter of said hole in defined by arcs of various radii opening in a plane substantially parallel to said head portion.

* * * * *